United States Patent [19]

Baugh et al.

[11] 4,105,096

[45] Aug. 8, 1978

[54] CHECKSTAND

[75] Inventors: Benjamin Charles Baugh, Wichita, Kans.; Norman R. Young; Glenmore J. Runnion, both of Oklahoma City, Okla.

[73] Assignee: Unarco Industries, Inc., Chicago, Ill.

[21] Appl. No.: 801,578

[22] Filed: May 31, 1977

[51] Int. Cl.[2] ..... E04H 3/04

[52] U.S. Cl. ..... 186/1 AC

[58] Field of Search ..... 186/1 R, 1 AC, 1 A, 186/24; 308/6 R; 312/26, 30, 140.1, 140.2, 250, 282, 314, 318

[56] References Cited

U.S. PATENT DOCUMENTS

| | | | |
|---|---|---|---|
| 3,220,790 | 11/1965 | White | 312/282 X |
| 3,557,907 | 1/1971 | Close | 186/1 AC |
| 3,815,932 | 6/1974 | Ruger | 186/1 AC X |
| 3,990,540 | 11/1976 | Aleshire et al. | 312/282 X |

*Primary Examiner*—Stephen G. Kunin

*Attorney, Agent, or Firm*—Dressler, Goldsmith, Clement Gordon & Shore

[57] ABSTRACT

A checkstand has a pivotable cash register stand and a counter across from the cash register stand onto which groceries or other items are unloaded. The checkstand generally defines one side of a customer aisle adjacent the counter and a separate cart aisle lying between the other side of the counter and the cash register stand. The cash register stand pivots to a blocking position in the cart aisle to prevent passage of shopping carts through the cart aisle when a shopping cart is being unloaded onto the counter, and subsequently pivots to an open position out of the path of the cart aisle to permit the unloaded shopping cart to exit through the cart aisle. Preferably, a stationary wall unit is mounted adjacent the cash register stand. In order to prevent the shopping carts from accidentally bumping and damaging the checkstand, the cast register stand, unloading counter, and wall unit each have a bumper, preferably in the form of a rotatable wheel or roller, to rotatably engage and guide the shopping cart through the cart aisle.

29 Claims, 7 Drawing Figures

FIG. 1
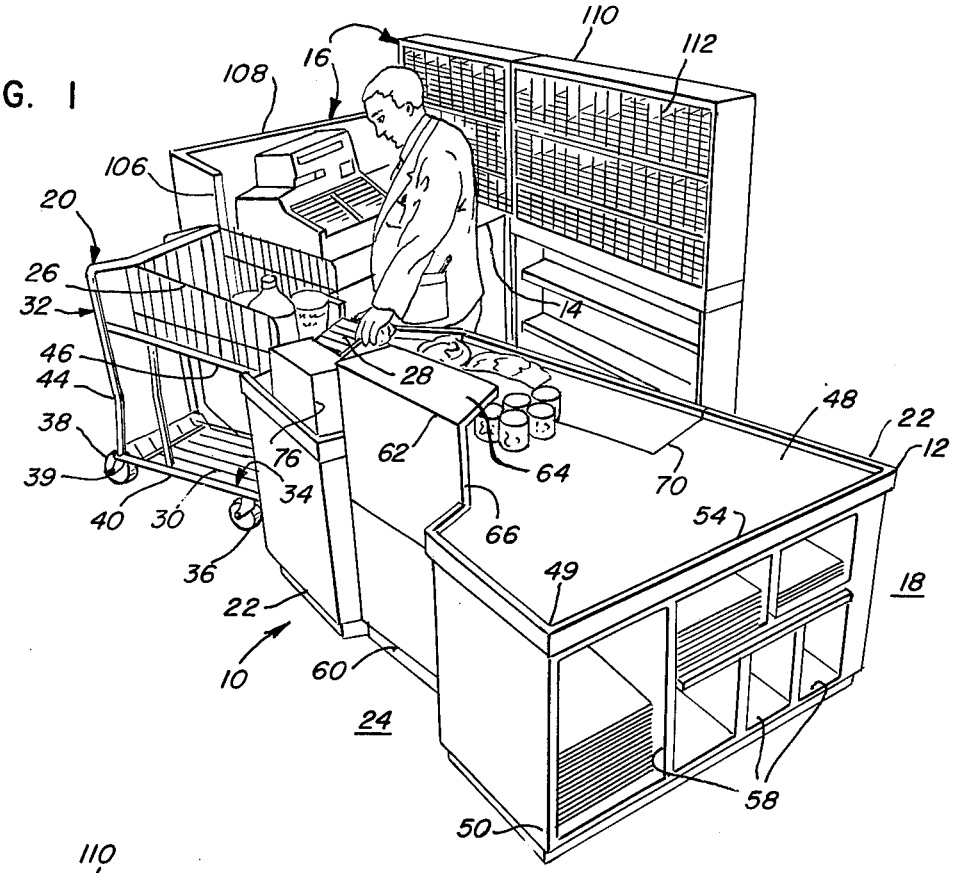
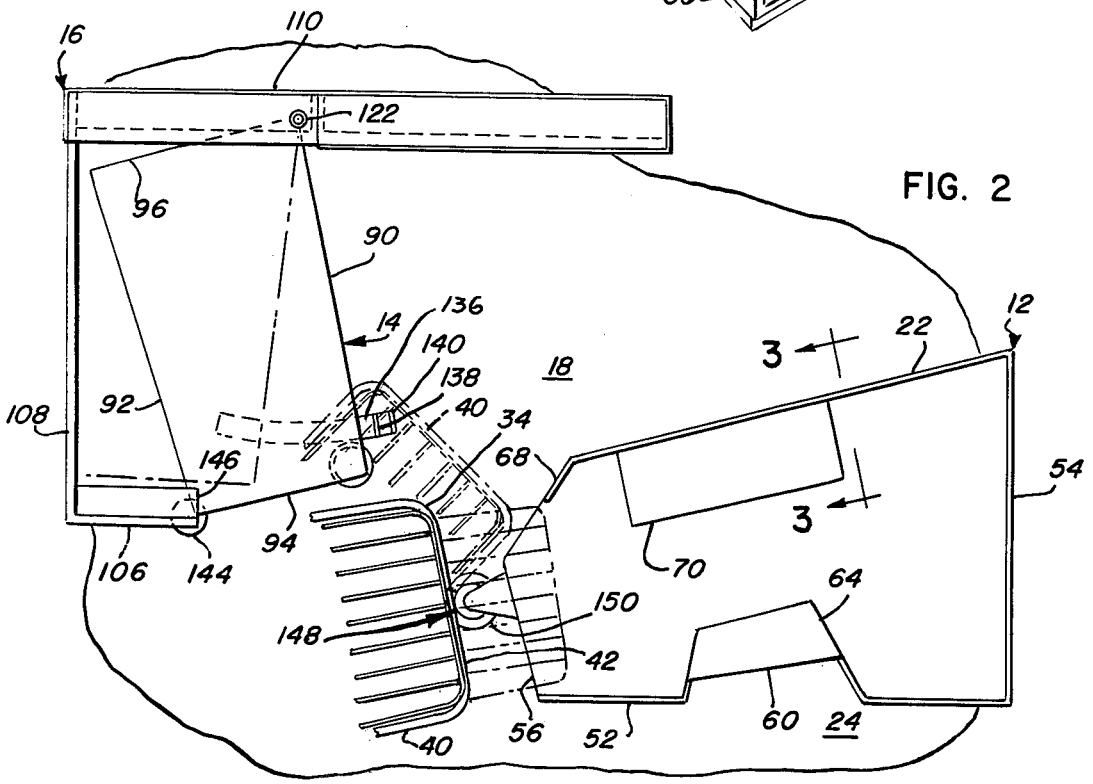
FIG. 2

CHECKSTAND

BACKGROUND OF THE INVENTION

This invention relates to a checkstand for use in grocery stores and the like, and more particularly, to a checkstand having a customer aisle and a separate cart aisle.

Conventional checkstands traditionally have a cash register mounted on the same counter onto which groceries are unloaded, rung up, and bagged. Typical of such prior art constructions are U.S. Pat. Nos. 3,860,091, 3,855,757, 3,869,065, and Des. 234,037. Such prior art constructions do not provide both an aisle for customers and a separate aisle for passage of shopping carts.

U.S. Pat. No. 3,052,319 illustrates a cash register stand which is spaced apart fron the counter, but does not have both an aisle for customers and a separate aisle for passage of carts.

Another type of checkstand has a cash register stand which is spaced apart from an unloading counter so as to provide a separate cart aisle and customer aisle. See, for example, U.S. Pat. No. 3,789,957 and particularly FIG. 13. Such prior art constructions, however, do not permit the cash register stand to be conveniently moved near the unloading counter and shopping cart when groceries are being unloaded from the shopping cart, nor do they permit the cash register stand to be subsequently moved out of the cart aisle and away from the counter and cart after the groceries have been unloaded to permit the unloaded cart to exit through the cart aisle.

Another problem that often occurs in these prior art constructions is that the unloading counter, cash register stand, and adjacent walls are sometimes accidentally bumped by shopping carts, particularly when a cart is being pushed against the counter for unloading or when the cart is being pulled or pushed through the cart aisle after unloading. This bumping and the resultant impact forces therefrom may cause damage and wear to the checkstand, especially if the checkstand is being constantly or repetitively bumped or if the impact forces are great.

SUMMARY OF THE INVENTION

A checkstand is provided that overcomes most, if not all, of the preceding disadvantages and which provides for over-the-counter type discharge of groceries from an upper basket of a shopping cart. The checkstand is particularly useful in a grocery store or the like and has a customer aisle for egress of customers and a separate cart aisle for passage of shopping carts.

The checkstand includes a cash register stand for supporting a cash register-like machine at a level at which a check-out clerk can conveniently operate the machine. Pivoting means are operatively connected to the cash register stand so that the cash register stand can be pivoted from a first position, substantially blocking the cart aisle during unloading of the shopping cart, with the cash register stand in proximity to the shopping cart, to a second open position adjacent the cart aisle to freely permit passage of the unloaded shopping cart through the cart aisle.

The checkstand preferably further includes moving means, such as a rotatable wheel extending downwardly from the cash register stand and riding on the floor for accommodating movement of the cash register stand along the floor. Desirably, a metal protection plate is mounted on the floor to engage the rotatable wheel. In the illustrative embodiment, the metal protection plate has at least one upwardly extending protuberance defining an abutment stop adjacent the cart aisle for limiting the movement of the rotatable wheel and cash register stand toward the cart aisle.

The cash register stand desirably has an elongated platform which defines a generally planar top surface for supporting a scale and the cash register-like machine in side-by-side relationship, and has a base for supporting and elevating the elongated platform to a desired height.

In the preferred embodiment, a wall is positioned adjacent the cash register stand and an unloading counter is provided which is spaced across from the cash register stand and wall. The unloading counter has an elongated counter surface for receiving groceries or the like from a shopping cart, preferably a counter-level type shopping cart. The unloading counter includes a support assembly or frame for supporting and elevating the counter surface to a desired height. The support assembly or frame has one elongated side positioned adjacent the customer aisle and another elongated side positioned adjacent the cart aisle and spaced across from the cash register stand. The support assembly or frame of the counter further has a front supporting surface which generally faces the shopping cart when the cart is being unloaded.

Another feature of this invention is the provision of novel bumpers which substantially protect the checkstand from being bumped into and damaged by a shopping cart. To this end a base-mounted wheel is mounted to the base or cabinet of the cash register stand, a wall-mounted wheel is mounted to the wall adjacent the cash register stand, and another wheel means is mounted to the front supporting surface of the unloading counter. Each of the wheels or wheel means projects into the cart aisle and serves as a barrier to substantially protect the cash register stand, wall and unloading counter, respectively, from being bumped into and damaged by a shopping cart.

In the illustrative embodiment, the base-mounted wheel means on the cash register stand is positioned at a height for rotatably engaging the upper basket of the shopping cart and the wall-mounted wheel is positioned at a height for rotatably engaging the base, and preferably the rear caster horn or rear wheel of the base, of the shopping cart. The wheel means mounted on the unloading counter is positioned at a height for engaging the base of the shopping cart.

In the preferred embodiment, the counter-mounted wheel means includes a cylindrical roller for engaging the nose of the base of the shopping cart during unloading of the cart and includes a rotatable wheel positioned above the cylindrical roller for rotatably engaging the horizontal runs or sides of the base of the shopping cart after the cart has been unloaded.

A more detailed explanation of the invention is provided in the following description and appended claims taken in conjunction with the accompanying drawing.

BRIEF DESCRIPTION OF THE DRAWINGS

FIG. 1 is a perspective view of a checkstand with a shopping cart being unloaded in accordance with principles of the present invention;

FIG. 2 is a top plan view of the checkstand illustrating in solid line the cash register stand and fragmentary portions of the cart during unloading and depicting in phantom line the gate of the shopping cart and the upper bumper wheel of the counter during unloading as well as showing in phantom line the cash register stand and fragmentary portion of the cart when subsequently moved after unloading;

DETAILED DESCRIPTION OF THE ILLUSTRATIVE EMBODIMENT

Figure 3:
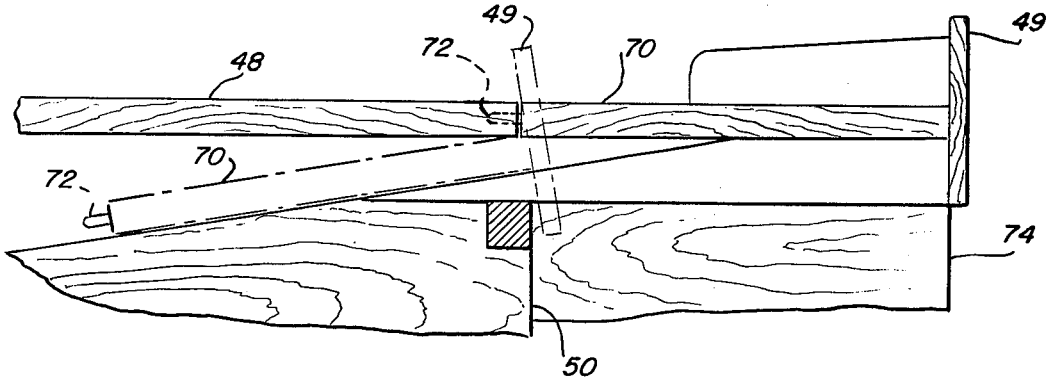
FIG. 3 is a fragmentary, sectional view of a movable portion of the unloading counter top over a bag well in the counter taken substantially along line 3—3 of FIG. 2 illustrating in solid line the movable portion of the counter surface closed over the bag well and showing in phantom line the movable portion of the counter surface positioned to expose the bag well.

Referring to the drawings, a checkstand 10 is provided for use in a grocery store, although it is to be understood that the checkstand can be used in other stores for unloading and itemizing items other than groceries as well. The checkstand includes an unloading counter 12, a cash register stand 14 and a wall unit 16 (see also FIG. 2). The cash register stand 14 and wall unit 16 are spaced away from the unloading counter 12 so as to define a cart aisle 18 between (1) the counter 12 and (2) the cash register stand 14 and wall unit 16, for passage of a shopping cart 20 after the groceries in the cart have been unloaded onto the counter 12. The elongated area adjacent the elongated side 22 of the unloading counter 12, which faces away from the cash register stand 14 and wall unit 16, generally defines one side of a customer aisle 24 in which the customer may stand and observe the groceries being unloaded, itemized and bagged. The customer aisle 24 serves as an exit passageway for egress of customers. Preferably, an adjoining checkstand (not shown) is positioned along and adjacent the customer aisle 24, but spaced from and opposite the customer side 22 of counter 12 so as to limit the width of the customer aisle 24.

The checkstand 10 is designed to be used in conjunction with a counter-level type shopping cart 20, such as the shopping cart shown in U.S. Pat. No. 3,645,554. Other types of carts can also be used.

In the illustrative embodiment, the shopping cart 20 has an upper elongated basket 26 with a pivotable front gate 28 that can be lowered, as illustrated in FIG. 1, to serve as a ramp for unloading groceries onto counter 12. A lower basket 30 can be provided for supporting bulky items, such as potatoes, watermelons, bottles of soft drinks and the like. The upper and lower baskets, 26 and 30, respectively, are supported by a support frame 32.

Figure 4:
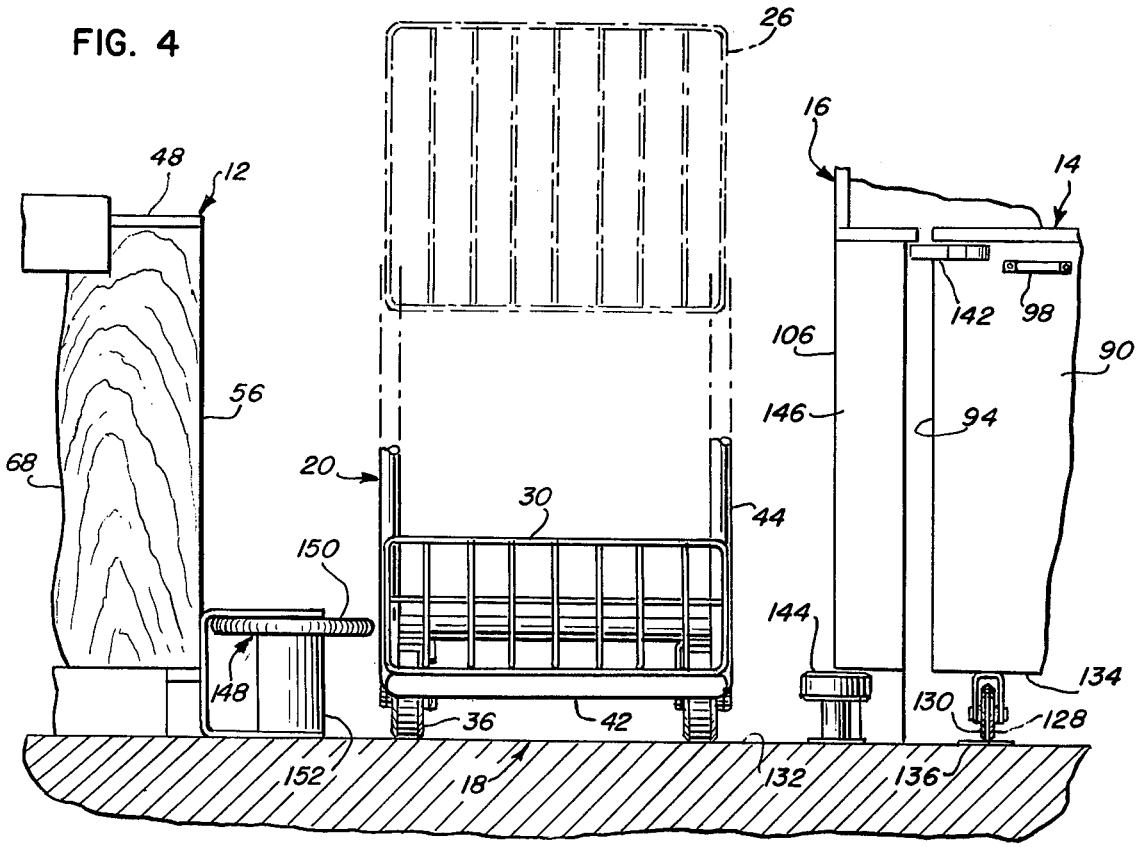
FIG. 4 is an enlarged fragmentary front view of the checkstand and cart as generally viewed by the checkout clerk adjacent the cash register stand.
Figure 7:
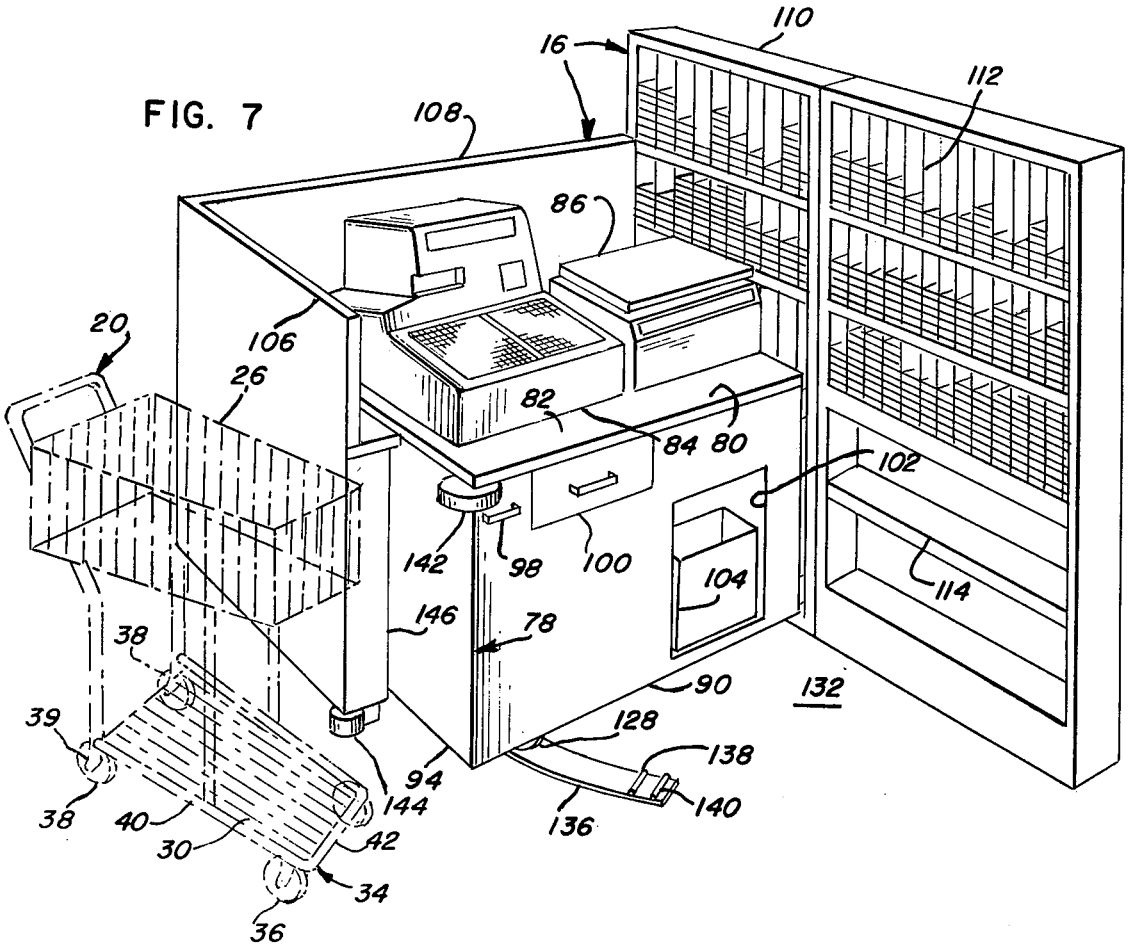
FIG. 7 is a perspective view of the cash register stand and adjacent wall unit.

The shopping cart 20 has a base 34 for supporting and carrying the lower basket 30. Base 34 generally defines an undercarriage having front and rear wheels or casters, 36 and 38, respectively. Each of the wheels 36 and 38 has a metal caster horn 39 which covers a portion of a lateral side of the wheel and provides a surface for holding and supporting the wheel axle. The base 34 is generally U-shaped and has horizontal runs or sides 40 and, as shown in FIGS. 4 and 7, a downwardly-turned nose or toe 42 at its front end.

The support frame 32 of the shopping cart 20 further includes post-like supports or uprights 44 extending upwardly from each of the horizontal runs 40, respectively, of the base 34. A horizontal upper basket support 46 is cantilevered from the post-like support 44 for supporting the upper basket 26.

Referring now to the counter 12 upon which the groceries are unloaded, the counter 12 includes an elongated counter surface 48 for receiving the groceries from the upper basket 26 of the cart 20. A support assembly or frame 50 supports and elevates the counter surface 48 to a position substantially at the level of, or slightly below, the bottom of the upper basket 26. Preferably, the counter surface 48 is surrounded by a curb or upwardly extending railing or flange 49 to retain the groceries on the surface.

The support assembly or frame 50 of the counter 12 includes elongated sides 22 and 52, side 22 being positioned adjacent the customer aisle 24, and side 52 being positioned adjacent the cart aisle 18 and spaced generally across from the cash register stand 14 and wall unit 16. The sides 22 and 52 are spaced apart. The counter surface 48 generally slopes downwardly towards the back supporting surface 54 of counter 12 and can, if desired, also slope towards side 22.

As shown in FIG. 2, the counter 12 has end walls including a front supporting surface 56 and a back supporting surface 54 which extend between and connect the sides 22 and 52 of the counter 12. The front supporting surface 56 generally faces the shopping cart 20 during unloading of the cart. The back supporting surface 54 has a plurality of various sized compartments or pockets 58 (FIG. 1) for holding different sized shopping bags.

As shown in FIGS. 1 and 2, the middle portion 60 of the customer side 22 of counter 12 extends laterally inwardly to define a space in which the customer can stand and observe the groceries being unloaded and itemized. An auxiliary checkwriting stand 62 extends upwardly from the middle portion 60 of the customer side 52 of the counter 12. The auxiliary checkwriting stand 62 generally has the shape of an inverted "L" and includes a planar horizontal surface 64 that extends laterally inwardly over the counter surface 48 to provide a surface upon which a customer can write a check or handle money. The horizontal surface 64 is supported and elevated above the middle portion 60 of the customer side 22 of the counter 12 by an upright support 66.

The cart side 52 of the counter 12 may also have a plurality of compartments or pockets (not shown) for holding various size shopping bags or other objects. As is best shown in FIG. 2, the forward end 68 of the cart side 52 of the counter 12 slopes toward the front supporting surface 56 of the counter 12 so as not to project into the cart aisle 18 and interfere with the passage of carts through the cart aisle 18.

Referring to FIGS. 2 and 3, the counter surface 48 includes a movable counter portion or slide plate 70 positioned adjacent the cart side 52 of the counter 12 and across from the auxiliary checkwriting stand 62. The slide plate 70 is held in place by a dowel 72 inserted in a receiving aperture in the stationary portion of the counter below surface 48. When a portion of the curb or railing 49 is pulled out, to the right in FIG. 3, the dowel 72 is removed, and the slide plate 70 can be tipped slightly and pushed laterally inwardly so that the slide plate 70 slides under and slightly below the other portions of the counter surface 48 as shown in phantom line in FIG. 3. When the slide plate 70 is moved inwardly to the position illustrated in phantom in FIG. 3, a lower portion of the cart side 52 of the counter 12 is thus exposed and defines a laterally inwardly extending bag well 74 into which shopping bags can be placed for bagging the groceries. In some circumstances, it is desirable to keep the slide plate 70 laterally outwardly so that the groceries can be bagged adjacent the back supporting surface 54.

An optical scanner 76 (FIG. 1) is mounted on the counter surface 48 adjacent the customer side 22 of the counter 12, between the auxiliary checkwriting stand 62 and the front supporting surface 56. The counter 12 can be utilized for both checker unloading or customer participation.

Referring now to the cash register stand 14 which is positioned adjacent the cart aisle 18 across from the counter 12, the cash register stand 14, as shown in FIG. 7, includes a base or cabinet 78 for supporting and elevating an elongated platform 80. The elongated platform 80 has a top surface 82 which is generally planar for supporting a cash register-like machine, such as a cash register 84 in side-by-side relationship with a scale 86. Other cash register-like machines can be used, such as an adding machine, or a remote keyboard or cash drawer. Desirably, the base or cabinet 78 of the cash register stand 14 is of a height to elevate and support the platform 80 at a level at which a checkout clerk can conveniently operate the cash register or other cash register-like machine.

The cabinet 78 of the cash register stand 14 has upright cabinet walls, as shown in FIGS. 2 and 7, including a front 90 which generally faces the checkout clerk, a back 92 which is spaced rearwardly of the front 90 and adjacent the wall unit 16, and sides 94 and 96 which extend between and connect the front and back, 90 and 92, respectively. Side 94 of the cabinet 78 is positioned adjacent the cart aisle 18, while the side 96 of the cabinet is preferably positioned away from and remote from the cart aisle 18. Desirably, side 96 somewhat longer, between the front 90 and the back 92, than is side 94.

In the illustrative embodiment, the corner formed at the junction between the cart aisle side 94 and the back 92 of the cash register stand 14 is about 96° and the corner formed by the junction of the side 96 and the back 92 of the cash register stand 14 is about 90°. This arrangement and orientation permits the cash register stand 14 to freely pivot, as will hereinafter be explained, without bumping into the wall unit 16. The edges of the platform 80 are preferably flush with the cabinet walls.

A handle 98 extends slightly outwardly from the front 90 of the cabinet 78 so as to provide a manually graspable surface for holding and pivoting the cash register stand 14. The handle 98 is preferably positioned near the platform 80 and adjacent the cart side 94.

The front 90 of the cabinet 78 can also be provided with one or more drawers 100. In the illustrative embodiment, the front 90 of the cabinet defines a hole or compartment into which a removable trash bin or waste paper basket 104 is placed.

Referring now to the wall unit 16 which is positioned closely adjacent the cash register stand 14, the wall unit 16 is generally U-shaped and includes a cart aisle side wall 106 adjacent and extending along the cart aisle 18, an elongated rear wall 108 positioned adjacent and behind the back 92 of the cash register stand 14, and an elongated side wall 110 adjacent the side 96 of the cash register stand 14.

The wall unit 16 is stationary. The cart aisle side wall 106 and the elongated rear wall 108 are preferably elevated to a height above the cash register 84, although in some circumstances it may be desirable that walls 106 and 108 be no higher than the level of the platform 80 of the cash register stand 14 to permit viewing of the cash register 84 by the customer.

In the illustrative embodiment, the cart aisle side wall 106 is not as long as the cart side 94 of the cash register stand 14 so as to provide clearance for the bumper 142 on the cash register stand 14 as will be hereinafter explained.

Referring now to the elongated side wall 110 of wall unit 16, the elongated side wall 110 has a plurality of compartments 112 for holding cigarettes or the like and which are located generally above the platform 80 of the cash register stand 14. Positioned in front of the cash register stand 14 and below compartments 112, are a plurality of adjustable shelves 114 for holding various other items.

One of the features of this invention is the provision of means operatively connected to the cash register stand 14 for pivoting the cash register stand 14 from a first blocking position in proximity to the shopping cart 20 where it substantially blocks the cart aisle 18 during unloading of the shopping cart 20, to a second open position adjacent the cart aisle 18 for freely permitting passage of the shopping cart 20 through the cart aisle 18 after the shopping cart 20 has been unloaded.

Figure 6:
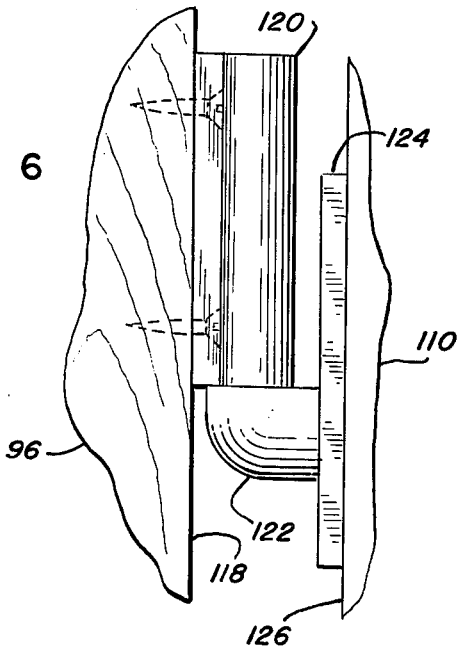
FIG. 6 is an enlarged perspective view of one of said pins and hinges.
Figure 5:
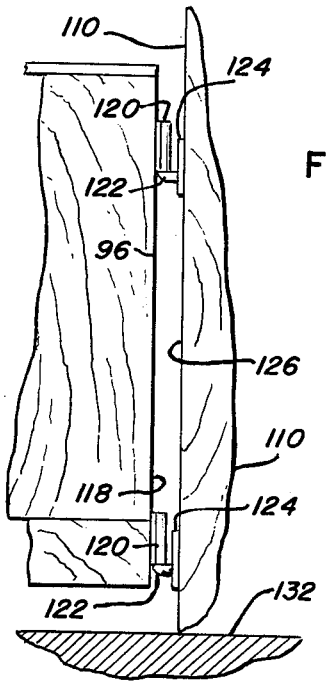
FIG. 5 is a fragmentary side view of the pin and hinge arrangement for the checkstand.

To this end the cash register stand 14 is pivotally hinged to the wall unit 16. In the preferred embodiment, the corner of the cabinet 78 of the cash register stand 14, which is formed by the junction of the side 96 and the front 90 of the cash register stand defines a mounting surface 118 as shown in FIGS. 5 and 6, onto which a pair of hinges 120 are mounted. Preferably the hinges are in vertical alignment with each other. Each hinge 120 is removably coupled to a pin or finger 122 which extends upwardly from a metal wall plate 124. Each wall plate 124 is mounted to another mounting surface 126, defined by an area of the elongated side wall 110 of the wall unit 16 that is located below the level of the platform 80 of the cash register stand 40, adjacent and across from the upright mounting surface 118 of the cash register stand 14. The pins generally define a pivot point adjacent the elongated side wall 110 and remote from the cart aisle 18. The pins 122 are vertically aligned for removable insertion into the hinges 120. The particular hinge and pin arrangement of this embodiment permits the cash register stand 14 to be lifted and subsequently removed from the wall unit 16 for cleaning, maintenance, or servicing or for other purposes. In some circumstances it may be desirable to mount the hinges 120 on the wall 110 and the pins 122 on the cash register stand 14.

In order to accommodate movement of the cash register stand 14 to and from a blocking position substantially blocking the cart aisle during unloading of the shopping cart 20 to an open position for freely permitting passage of the shopping cart 20 through the cart aisle 18 after the shopping cart has been unloaded, the checkstand 14 is provided with a downwardly-extending rotatable wheel or caster 128 (FIGS. 4 and 7). The wheel 128 extends downwardly from the under side 134 of the cabinet 78 and supports the base or cabinet 128.

The wheel 128 generally moves along an arcuate path as the cash register stand 12 is pivoted. Desirably, the wheel 128 is a high crown type wheel which has a relatively small apex 130 for minimal contact with the floor 132. For purposes of appearance and in order to hide the wheel 128 from view, the front 90 of the cabinet 78 can have a downwardly depending flange or skirt (not shown).

As shown in FIGS. 2 and 7, an arcuate metal protection plate 136 is mounted on the floor 132 so as to effectively become part of floor 132. The metal protection plate 136 serves as a track or load bearing surface upon which the wheel 128 rides. The metal protection plate has a first upwardly extending protuberance 138, defining an abutment stop, adjacent the cart aisle 18 for limiting the movement of wheel 128 and cash register stand 14 towards the cart aisle 18. The metal protection plate 136 desirably has a second upwardly extending protuberance 140, defining a safety abutment stop. The second protuberance 140 is positioned slightly beyond the first protuberance 138, in the direction of the cart aisle 18, to provide a safety stop in the event wheel 128 overrides the first protuberance 138. It may also be desirable in some circumstances to provide one or more similar protuberances or abutment stops towards the opposite end of the metal protection plate, for limiting the movement of the cash register stand 14 away from the cart aisle 18 when the cash register stand 14 is moved to the open position.

Another feature of this invention is the provision of novel bumpers for substantially protecting the checkstand 10 from being bumped into and damaged by shopping carts 20. To this end, the cash register stand 14 has a base-mounted rotatable wheel or caster 142, as shown in FIGS. 2, 4 and 7, which is mounted to the base or cabinet 78 of the cash register stand 14. In the illustrative embodiment the base-mounted wheel 142 is attached to the corner of the cabinet 78 that is formed by the junction of the cart side 94 and the front 90 of the cash register stand 14. Wheel 142 projects and extends into the cart aisle 18, and is preferably mounted so that the wheel rotates horizontally about a vertical axis. In the preferred embodiment, the base-mounted wheel 142 is positioned at a height to rotatably engage the front and side walls of the upper basket 26 of the shopping cart 20. Should the shopping cart 20 be accidentally pushed near the cash register stand 14 when being pushed or pulled through the cart aisle 18, the base-mounted wheel 142 will protect the cash register stand 14 from direct impact. In the illustrative embodiment, the wheel 142 is positioned to engage the area of the upper basket 26 which defines a zone generally midway between the top and bottom of the basket 26.

A wall-mounted rotatable wheel or caster 144, as shown in FIGS. 2, 4 and 7, is mounted to the cart aisle side wall 106 of the wall unit 16. The wall-mounted wheel 144 projects and extends into the cart aisle 18 and is preferably attached to the forward end 146 of the cart aisle side wall 106. Desirably, the wall-mounted wheel 144 is positioned to rotate horizontally, generally about a vertical axis, and is positioned at a height to rotatably engage the rear caster horn 39 of the rear wheel 38 of the shopping cart 20. Should the shopping cart 20 accidentally be pushed near the cart side wall 106 when the shopping cart 20 is being pushed or pulled through the cart aisle 18, the wall-mounted wheel or caster 144 will protect the wall 106 from direct impact.

Another wheel means or caster 148, as shown in FIGS. 2, 4 and 7, is mounted to the front supporting surface 56 of the counter 12. The counter-mounted wheel means 148 projects into the cart aisle 18 and is preferably attached to the front supporting surface 56 adjacent the forward end 68 of the cart side 52 of the counter 12.

The counter-mounted wheel means 148 includes an upper rotatable wheel 150 (FIG. 4) and a lower cylindrical roller 152. Preferably, the upper wheel 150 and the lower roller 152 have a common vertical axis. In the illustrative embodiment, the outside diameter of the upper wheel 150 is greater than the outside diameter of the lower roller 152. The lower roller 152 is preferably elongated and extends generally upwardly from a position adjacent the floor 132. The roller 152 shown rotates about a vertical axis, although it may be desirable, in some circumstances, that the roller 152 be stationary and non-rotatable. Desirably the cylindrical roller 152 is of a height to engage the nose 42 of the base 34 of the shopping cart 20 during unloading of the shopping cart 20 (see FIGS. 2 and 4).

The upper wheel 150 of the counter mounted wheel means 148 is rotatably seated above the cylindrical roller 152 and preferably rotates in a horizontal direction generally about a vertical axis. The upper wheel 150 extends into the cart aisle 18 and is positioned at a height to engage the horizontal runs 40 of the base 34 of the shopping cart 20 when the shopping cart is being pushed or pulled through the cart aisle 18 after the cart has been unloaded. The upper wheel 150 and the lower roller 152 together form a generally T-shaped bumper. Should the shopping cart 20 be accidentally brought near the counter 12, when pushed or pulled through the cart aisle 18, the counter mounted wheel means 148 will protect the counter 12 from direct impact.

The wheels 142, 144 and 150 and the roller 152 are made of a material having a hardness which is less than that of the metal shopping cart so that the wheels and rollers do not damage the shopping cart. Preferably, the wheels and rollers are made out of an elastomeric material, such as rubber, for cushioning the impact of the cart 20 and to dampen and attenuate mechanical vibration and/or noise resulting from impact.

When the cash register stand 14 is pivoted to an open position, so that the shopping cart 20 can be freely pushed or pulled through the cart aisle 18, the minimum distance between the counter-mounted wheel means 148 of the counter 12 and the base-mounted wheel 142 of the cash register stand 14 is such as to provide sufficient clearance space to permit the shopping cart 20 to freely pass through the cart aisle 18 without striking or engaging any of the bumpers or wheels 142, 144 and 148.

The wheels 142, 144, and 150 and roller 152 preferably spin and rotate so as to rotatably engage the shopping cart 20. The rotatable characteristics of these bumpers, i.e., the wheels 142, 144 and 150 and roller 152, generally provide for uniform wear of the bumpers and thus prolong the useful life of these bumpers. Furthermore, the rotatable characteristics of wheels 142, 144 and 150 generally provide rotatable guides dynamically guiding the shopping cart 20 through cart aisle 18.

The bumpers or wheels 142, 144 and 148 serve to protect cash register stand 14, the cart aisle side wall 106 of the wall unit 16, and the front supporting surface 56 of the counter 12, respectively, from being accidentally bumped into and damaged by the shopping cart 20.

This serves to protect the checkstand 10 from damage and wear caused by bumping and impact forces for shopping carts, thereby protecting the finish on the checkstand and prolonging the useful life of the checkstand.

When the cash register stand 14 is grasped by the handle 98 and pivoted to the blocking position so as to substantially block or prevent the passage of shopping carts 20 through the cart aisle 18, as shown in solid line in FIG. 2, the wheels and bumpers 142, 144 and 148 serve as guides to assist in correctly positioning the nose 42 of the shopping cart 20 against the lower roller 152 for unloading. The base-mounted wheel 142, the wall-mounted wheel 144 and the upper wheel 150 in the illustrated embodiment do not engage the shopping cart 20 when the shopping cart is being unloaded, but do serve to prevent the cart 20 from accidentally bumping into and damaging the cash register stand 14, the wall unit 16, and the unloading counter 12, respectively, when the shopping cart 20 is being moved into and out of the unloading position.

The above detailed description has been given for ease of understanding only. No unnecessary limitations are to be understood therefrom, as modifications will be obvious to those skilled in the art.

What is claimed is:

1. A checkstand for use in a grocery store or the like having a customer aisle for egress of customers and a cart aisle for passage of shopping carts, comprising:

a cash register stand for supporting a cash register-like machine at a level at which a checkout clerk can conveniently operate the cash register-like machine, said cash register stand extending from a position adjacent the floor to said level of said cash register-like machine; and pivoting means operatively connected to said cash register stand for pivoting said cash register stand from a first position substantially blocking the cart aisle from a position adjacent the floor to said level of said cash register-like machine and in close proximity to a shopping cart during unloading of said cart, to a second position adjacent said cart aisle for freely permitting passage of said shopping cart through said cart aisle after said shopping cart has been unloaded.

2. A checkstand in accordance with claim 1 further including moving means connected to said cash register stand for accommodating movement of said cash register stand along the floor.

3. A checkstand in accordance with claim 2 wherein said moving means includes a rotatable wheel extending downwardly from said cash register stand adjacent the bottom of said cash register stand and in contact with the floor.

4. A checkstand in accordance with claim 1 wherein said cash register stand has a generally planar top surface for supporting a scale and said cash register-like machine in side-by-side relationship.

5. A checkstand in accordance with claim 1 wherein said pivoting means defines a pivot point remote from the cart aisle

6. A checkstand for use in a grocery store or the like having a customer aisle for egress of customers and a cart aisle for passage of shopping carts, comprising:

an elongated platform for supporting a cash register-like machine;

pivotable base means for supporting and elevating said elongated platform to a level at which a checkout clerk can conveniently operate the cash register-like machine, said base extending from a position adjacent the floor to said level of said cash register-like machine; and bumper means secured to said pivotable base means adjacent said cart aisle for substantially protecting said base means from being bumped into and damaged by shopping carts.

7. A checkstand for use in a grocery store or the like having a customer aisle for egress of customers and a cart aisle for passage of shopping carts, comprising:

a cash register stand having an elongated platform for supporting a cash register-like machine and base means for supporting and elevating said elongated platform to a level at which a checkout clerk can conveniently operate the cash register-like machine;

a wall positioned adjacent said cash register stand; and wall-mounted wheel means mounted upon said wall and projecting into said cart aisle for rotatably engaging said shopping carts to substantially protect said wall from being bumped into and damaged by said shopping carts.

8. A checkstand in accordance with claim 7 wherein said wall-mounted wheel means is disposed at a height for rotatably engaging the base of a shopping cart.

9. A checkstand in accordance with claim 7 further including base-mounted wheel means mounted to said base means of said cash register stand and projecting into said cart aisle for rotatably engaging said shopping carts to substantially protect said cash register stand from being bumped into and damaged by said shopping carts.

10. A checkstand for use in a grocery store or the like having a customer aisle for egress of customers and a cart aisle for passage of shopping carts, comprising:

a cash register stand having an elongated platform for supporting a cash register-like machine and base means for supporting and elevating said elongated platform to a level at which a checkout clerk can conveniently operate the cash register-like machine;

a counter having an elongated counter surface for receiving groceries and support means for supporting and elevating said elongated counter surface, said counter having one elongated side adjacent the customer aisle and another elongated side spaced from said cash register stand and adjacent the cart aisle, and said support means having a front supporting surface generally facing the shopping cart during unloading of said shopping cart; and wheel means mounted upon said front supporting surface of said counter for engaging said shopping cart during unloading of said shopping cart and for substantially protecting said front support surface from being bumped into and damaged by said shopping cart.

11. A checkstand in accordance with claim 10 wherein said counter-mounted wheel means are disposed at a height for engaging the base of a shopping cart.

12. A checkstand in accordance with claim 11 for use with a shopping cart having a base with a nose portion, wherein said counter-mounted wheel means includes an elongated cylindrical roller for engaging said nose of the base of the shopping cart during unloading of the shopping cart, and a rotatable wheel positioned above the elongated cylindrical roller for rotatably engaging said base of the shopping cart after the cart has been unloaded.

13. A checkstand in accordance with claim 10 further including base-mounted wheel means mounted to said base means of said cash register stand and projecting into said cart aisle for rotatably engaging said shopping carts to substantially protect said cash register stand from being bumped into and damaged by said shopping carts.

14. A checkstand in accordance with claim 10 further including:

a wall positioned adjacent said cash register stand; and wall-mounted wheel means mounted upon said wall and projecting into said cart aisle for rotatably engaging said shopping carts to substantially protect said wall from being bumped into and damaged by said shopping carts.

15. A checkstand in accordance with claim 10 further including:

base-mounted wheel means mounted to said base means of said cash register stand and projecting into said cart aisle for rotatably engaging said shopping carts to substantially protect said cash register stand from being bumped into and damaged by said shopping carts;

a wall positioned adjacent said cash register stand; and wall-mounted wheel means mounted upon said wall and projecting into said cart aisle for rotatably engaging said shopping carts to substantially protect said wall from being bumped into and damaged by said shopping carts.

16. A checkstand for use in a grocery store or the like having a customer aisle for egress of customers and a cart aisle for passage of shopping carts, comprising:

a cash register stand having an elongated platform for supporting a cash register-like machine and base means for supporting and elevating said elongated platform to a level at which a checkout clerk can conveniently operate the cash register-like machine, said base means extending from a position adjacent the floor to said level of said cash register-like machine;

pivoting means operatively connected to said base means for pivoting said base means from a first position substantially blocking the cart aisle from a position adjacent the floor to said level of said cash register-like machine and in close proximity to a shopping cart during unloading of said cart, to a second position adjacent said cart aisle for freely permitting passage of said shopping cart through said cart aisle after said shopping cart has been unloaded;

a counter having an elongated counter surface for receiving groceries and support means for supporting and elevating said elongated counter surface, said counter having one elongated side adjacent the customer aisle and another elongated side spaced from said cash register stand and adjacent the cart aisle, and said support means having a front supporting surface generally facing the shopping cart during unloading of said shopping cart.

17. A checkstand for use in a grocery store or the like having a customer aisle for egress of customers and a cart aisle for passage of shopping carts, comprising:

a cash register stand for supporting a cash register-like machine at a level at which a checkout clerk can conveniently operate the cash register-like machine;

pivoting means operatively connected to said cash register stand for pivoting said cash register stand from a first position substantially blocking the cart aisle and in close proximity to a shopping cart during unloading of said cart, to a second position adjacent said cart aisle for freely permitting passage of said shopping cart through said cart aisle after said shopping cart has been unloaded;

moving means connected to said cash register stand for accommodating movement of said cash register stand along the floor;

said moving means including a rotatable wheel extending downwardly from said cash register stand adjacent the bottom of said cash register stand and in contact with the floor; and a metal protection plate mounted on said floor for engaging said rotatable wheel.

18. A checkstand for use in a grocery store or the like having a customer aisle for egress of customers and a cart aisle for passage of shopping carts, comprising:

a cash register stand for supporting a cash register-like machine at a level at which a checkout clerk can conveniently operate the cash register-like machine;

pivoting means operatively connected to said cash register stand for pivoting said cash register stand from a first position substantially blocking the cart aisle and in close proximity to a shopping cart during unloading of said cart, to a second position adjacent said cart aisle for freely permitting passage of said shopping cart through said cart aisle after said shopping cart has been unloaded;

moving means connected to said cash register stand for accommodating movement of said cash register stand along the floor;

said moving means including a rotatable wheel extending downwardly from said cash register stand adjacent the bottom of said cash register stand and in contact with the floor; and a metal protection plate mounted on said floor for engaging said rotatable wheel; and said metal protection plate having at least one upwardly extending protuberance defining an abutment stop adjacent said cart aisle for limiting the movement of said rotatable wheel toward said cart aisle.

19. A checkstand for use in a grocery store or the like having a customer aisle for egress of customers and a cart aisle for passage of shopping carts, comprising:

an elongated platform for supporting a cash register-like machine;

base means for supporting and elevating said elongated platform to a level at which a checkout clerk can conveniently operate the cash register-like machine;

bumper means secured to said base means adjacent said cart aisle for substantially protecting said base means from being bumped into and damaged by shopping carts; and said bumper means including rotatable wheel means projecting into said cart aisle.

20. A checkstand for use in a grocery store or the like having a customer aisle for egress of customers and a cart aisle for passage of shopping carts, comprising:

an elongated platform for supporting a cash register-like machine;

base means for supporting and elevating said elongated platform to a level at which a checkout clerk can conveniently operate the cash register-like machine;

bumper means secured to said base means adjacent said cart aisle for substantially protecting said base means from being bumped into the damaged by shopping carts;

said bumper means including rotatable wheel means projecting into said cart aisle; and said rotatable wheel means being disposed generally along a horizontal plane.

21. A checkstand for use with a shopping cart having an upper basket in a grocery store or the like having a customer aisle for egress of customers and a cart aisle for passage of shopping carts, comprising:

an elongated platform for supporting a cash register-like machine;

base means for supporting and elevating said elongated platform to a level at which a checkout clerk can conveniently operate the cash register-like machine;

bumper means secured to said base means adjacent said cart aisle for substantially protecting said base means from being bumped into and damaged by shopping carts;

said bumper means including rotatable wheel means projecting into said cart aisle; and said rotatable wheel means being disposed generally along a horizontal plane and at a height for rotatably engaging said upper basket of the shopping cart.

22. A checkstand for use in a grocery store or the like having a customer aisle for egress of customers and a cart aisle for passage of shopping carts, comprising:

an elongated platform for supporting a cash register-like machine;

base means for supporting and elevating said elongated platform to a level at which a checkout clerk can conveniently operate the cash register-like machine;

bumper means secured to said base means adjacent said cart aisle for substantially protecting said base means from being bumped into and damaged by shopping carts;

said bumper means including rotatable wheel means projecting into said cart aisle; and pivoting means operatively connecting to said base means for pivoting said base means from a first position substantially blocking the cart aisle during unloading of said shopping cart for positioning said elongated platform in proximity to said shopping cart, to a second position adjacent said cart aisle for freely permitting passage of said shopping cart through said cart aisle after said shopping cart has been unloaded.

23. A checkstand for use in a grocery store or the like having a customer aisle for egress of customers and a cart aisle for passage of shopping carts, comprising:

a cash register stand having an elongated platform for supporting a cash register-like machine and base means for supporting and elevating said elongated platform to a level at which a checkout clerk can conveniently operate the cash register-like machine;

pivoting means operatively connected to said base means for pivoting said base means from a first position substantially blocking the cart aisle and in close proximity to a shopping cart during unloading of said cart, to a second position adjacent said cart aisle for freely permitting passage of said shopping cart through said cart aisle after said shopping cart has been unloaded;

a counter having an elongated counter surface for receiving groceries and support means for supporting and elevating said elongated counter surface, said counter having one elongated side adjacent the customer aisle and another elongated side spaced from said cash register stand and adjacent the cart aisle, and said support means having a front supporting surface generally facing the shopping cart during unloading of said shopping cart;

base-mounted wheel means mounted to said base means of said cash register stand and projecting into said cart aisle for rotatably engaging said shopping carts to substantially protect said cash register stand from being bumped into and damaged by said shopping carts; and wheel means mounted upon said front supporting surface of said counter for engaging said shopping cart during unloading of said shopping cart and for substantially protecting said front support surface from being stricken and damaged by said shopping cart.

24. A checkstand in accordance with claim 23 wherein:

said base-mounted wheel means are disposed at a height for rotatably engaging an upper basket of a shopping cart; and said counter-mounted wheel means are disposed at a height for rotatably engaging a base of said shopping cart.

25. A checkstand for use in a grocery store or the like having a customer aisle for egress of customers and a cart aisle for passage of shopping carts, comprising:

a cash register stand having an elongated platform for supporting a cash register-like machine and base means for supporting and elevating said elongated platform to a level at which a checkout clerk can conveniently operate the cash register-like machine;

pivoting means operatively connected to said base means for pivoting said base means from a first position substantially blocking the cart aisle and in close proximity to a shopping cart during unloading of said cart, to a second position adjacent said cart aisle for freely permitting passage of said shopping cart through said cart aisle after said shopping cart has been unloaded;

a counter having an elongated counter surface for receiving groceries and support means for supporting and elevating said elongated counter surface, said counter having one elongated side adjacent the customer aisle and another elongated side spaced from said cash register stand and adjacent the cart aisle, and said support means having a front supporting surface generally facing the shopping cart during unloading of said shopping cart;

a wall positioned adjacent said cash register stand and defining a first mounting surface;

said base means of said cash register stand defining a second mounting surface; and said pivoting means including at least one pin attached to one of said mounting surfaces and at least one hinge secured to the other of said mounting surfaces for pivotally receiving said pin.

26. A checkstand for use in a grocery store or the like having a customer aisle for egress of customers and a cart aisle for passage of shopping carts, comprising:

a cash register stand having an elongated platform for supporting a cash register-like machine and base means for supporting and elevating said elongated platform to a level at which a checkout clerk can conveniently operate the cash register-like machine;

pivoting means operatively connected to said base means for pivoting said base means from a first position substantially blocking the cart aisle and in close proximity to a shopping cart during unloading of said cart, to a second position adjacent said cart aisle for freely permitting passage of said shopping cart through said cart aisle after said shopping cart has been unloaded;

a counter having an elongated counter surface for receiving groceries and support means for supporting and elevating said elongated counter surface, said counter having one elongated side adjacent the customer aisle and another elongated side spaced from said cash register stand and adjacent the cart aisle, and said support means having a front supporting surface generally facing the shopping cart during unloading of said shopping cart;

a wall positioned adjacent said cash register stand and defining a first mounting surface;

said base means of said cash register stand defining a second mounting surface;

said pivoting means including at least one pin attached to one of said mounting surfaces and at least one hinge secured to the other of said mounting surfaces for pivotally receiving said pin; and said pin extending upwardly and said hinge being removably coupled to said pin so that said base means can be moved away from said wall.

27. A checkstand for use in a grocery store or the like having a customer aisle for egress of customers and a cart aisle for passage of shopping carts, comprising:

a cash register stand having an elongated platform for supporting a cash register-like machine and base means for supporting and elevating said elongated platform to a level at which a checkout clerk can conveniently operate the cash register-like machine;

pivoting means operatively connected to said base means for pivoting said base means from a first position substantially blocking the cart aisle and in close proximity to a shopping cart during unloading of said cart, to a second position adjacent said cart aisle for freely permitting passage of said shopping cart through said cart aisle after said shopping cart has been unloaded;

a counter having an elongated counter surface for receiving groceries and support means for supporting and elevating said elongated counter surface, said counter having one elongated side adjacent the customer aisle and another elongated side spaced from said cash register stand and adjacent the cart aisle, and said support means having a front supporting surface generally facing the shopping cart during unloading of said shopping cart;

a wall positioned adjacent said cash register stand and defining a first mounting surface;

said base means of said cash register stand defining a second mounting surface;

said pivoting means including at least one pin attached to one of said mounting surfaces and at least one hinge secured to the other of said mounting surfaces for pivotally receiving said pin;

a rotatable wheel connected to said base means of said cash register stand for accommodating movement of said cash register stand over the floor, said rotatable wheel connected to and supporting said base means of said cash register; and a metal protector plate mounted on said floor for providing a load bearing path under said rotatable wheel of said cash register stand, said metal protector plate having at least one upwardly extending protuberance defining an abutment stop ajacent said cart aisle for limiting the movement of said rotatable wheel and said cash register stand toward said cart aisle.

28. A checkstand for use in a grocery store or the like having a customer aisle for egress of customers and a cart aisle for passage of shopping carts, comprising:

a cash register stand having an elongated platform for supporting a cash register-like machine and base means for supporting and elevating said elongated platform to a level at which a checkout clerk can conveniently operate the cash register-like machine;

pivoting means operatively connected to said base means for pivoting said base means from a first position substantially blocking the cart aisle and in close proximity to a shopping cart during unloading of said cart, to a second position adjacent said cart aisle for freely permitting passage of said shopping cart through said cart aisle after said shopping cart has been unloaded;

a counter having an elongated counter surface for receiving groceries and support means for supporting and elevating said elongated counter surface, said counter having one elongated side adjacent the customer aisle and another elongated side spaced from said cash register stand and adjacent the cart aisle, and said support means having a front supporting surface generally facing the shopping cart during unloading of said shopping cart;

a wall positioned adjacent said cash register stand and defining a first mounting surface;

said base means of said cash register stand defining a second mounting surface;

said pivoting means including at least one pin attached to one of said mounting surfaces and at least one hinge secured to the other of said mounting surfaces for pivotally receiving said pin;

wall-mounted wheel means mounted upon said wall and projecting into said cart aisle for rotatably engaging said shopping carts to substantially protect said wall from being bumped into and damaged by said shopping carts;

base-mounted wheel means mounted to said base means of said cash register stand and projecting into said cart aisle for rotatably engaging said shopping carts to substantially protect said cash register stand from being bumped into and damaged by said shopping carts; and wheel means mounted upon said front supporting surface of said counter for engaging said shopping cart during unloading of said shopping cart and for substantially protecting said front supporting surface from being bumped into and damaged by said shopping cart.

29. A checkstand for use in a grocery store or the like having a customer aisle for egress of customers and a cart aisle for passage of shopping carts, comprising:

a cash register stand having an elongated platform for supporting a cash register-like machine and base means for supporting and elevating said elongated platform to a level at which a checkout clerk can conveniently operate the cash register-like machine;

pivoting means operatively connected to said base means for pivoting said base means from a first position substantially blocking the cart aisle and in close proximity to a shopping cart during unloading of said cart, to a second position adjacent said cart aisle for freely permitting passage of said shopping cart through said cart aisle after said shopping cart has been unloaded;

a counter having an elongated counter surface for receiving groceries and support means for supporting and elevating said elongated counter surface, said counter having one elongated side adjacent the customer aisle and another elongated side spaced from said cash register stand and adjacent the cart aisle, and said support means having a front supporting surface generally facing the shopping cart during unloading of said shopping cart;

a wall positioned adjacent said cash register stand and defining a first mounting surface;

said base means of said cash register stand defining a second mounting surface;

said pivoting means including at least one pin attached to one of said mounting surfaces and at least one hinge secured to the other of said mounting surfaces for pivotally receiving said pin;

wall-mounted wheel means mounted upon said wall and projecting into said cart aisle for rotatably engaging said shopping carts to substantially protect said wall from being bumped into and damaged by said shopping carts;

base-mounted wheel means mounted to said base means for said cash register stand and projecting into said cart aisle for rotatably engaging said shopping carts to substantially protect said cash register stand from being bumped into and damaged by said shopping carts;

wheel means mounted upon said front supporting surface of said counter for engaging said shopping cart during unloading of said shopping cart and for substantially protecting said front supporting surface from being bumped into and damaged by said shopping cart;

said base-mounted wheel means being disposed at a height for rotatably engaging an upper basket of a shopping cart;

said counter-mounted wheel means being disposed at a height for engaging a base of said shopping cart; and said wall-mounted wheel means being disposed at a height for rotatably engaging the base of said shopping cart.

* * * * *

UNITED STATES PATENT AND TRADEMARK OFFICE

CERTIFICATE OF CORRECTION

PATENT NO. : 4,105,096

DATED : August 8, 1978

INVENTOR(S) : Benjamin Charles Baugh; Norman R. Young; Glenmore J. Runnion

It is certified that error appears in the above-identified patent and that said Letters Patent are hereby corrected as shown below:

Abstract, line 16, "cast" should be --cash--;
Column 1, line 18, "fron" should be --from--;
Column 5, line 43, after "96" insert "is";
Column 18, line 13, "for" should be --of--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*